United States Patent [19]

Reddi

[11] 4,247,963

[45] Feb. 3, 1981

[54] LIQUID SUPPORT CONSTRUCTION

[76] Inventor: Lakshmi Reddi, 2265 Lichen La., Tustin, Calif. 92680

[21] Appl. No.: 28,684

[22] Filed: Apr. 10, 1979

[51] Int. Cl.[3] ..... A47C 27/08

[52] U.S. Cl. ..... 5/450; 5/451; 5/441; 156/145

[58] Field of Search ..... 5/451, 452, 450, 455, 5/441, 449; 428/178; 297/DIG. 3; 156/145

[56] References Cited

U.S. PATENT DOCUMENTS

| | | | |
|---|---|---|---|
| 3,864,768 | 2/1975 | Fraige et al. | 5/452 |
| 3,983,587 | 10/1976 | Gorran | 5/452 |
| 4,073,021 | 2/1978 | Carlisle | 5/451 |

*Primary Examiner*—Roy D. Frazier
*Assistant Examiner*—Alexander Grosz
*Attorney, Agent, or Firm*—Smyth, Pavitt, Siegemund, Jones & Martella

[57] ABSTRACT

A support construction includes two different-size sheets, the smaller one being sealed along all of its margins to the larger one, and the assembly is folded over, the smaller sheet being on the inside while overlapping margins of the larger sheet are sealed, in order to form a flat air compartment bonded by a liquid compartment having an upper and a lower portion. Additional seal points between the sheets establish obstructions for the liquid. An alternative form uses a flattened and folded lower sleeve. Valves permit filling of the compartments.

16 Claims, 16 Drawing Figures

FIG. 5
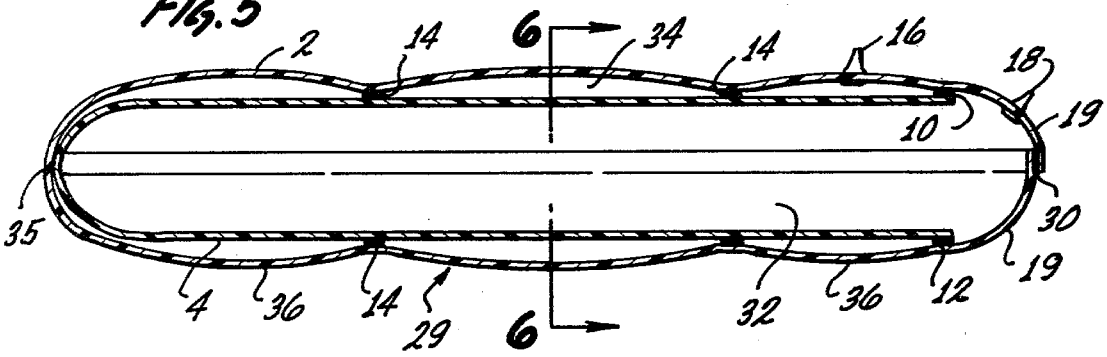
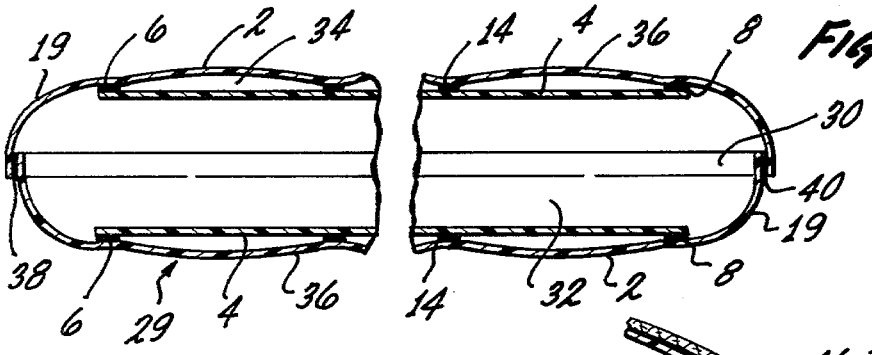
FIG. 6
FIG. 7
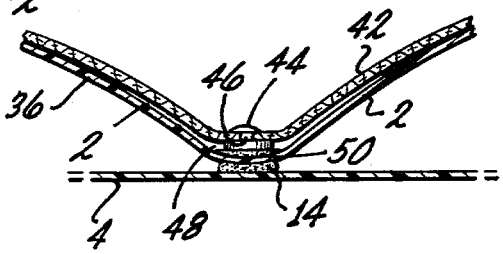
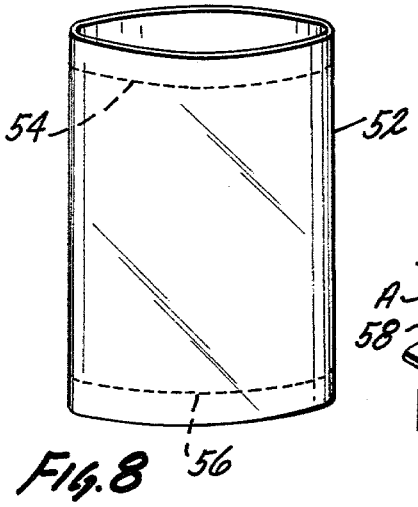
FIG. 8
FIG. 9
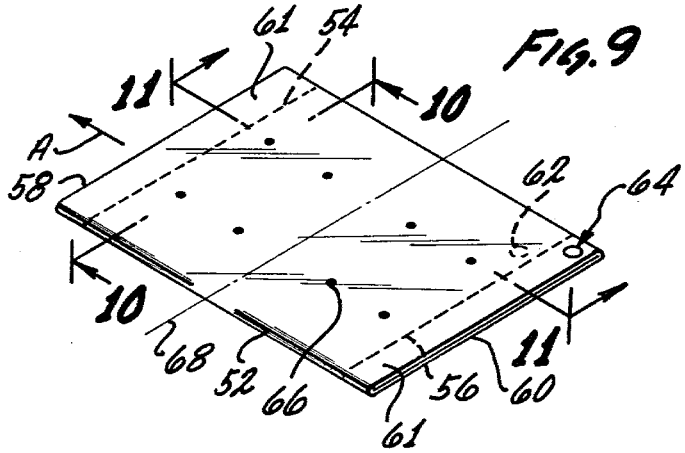

LIQUID SUPPORT CONSTRUCTION

BACKGROUND OF THE INVENTION

The present invention relates to a support construction using a liquid.

The use of a liquid-filled support member to uniformly support the weight of the human body is known and is used extensively in the construction of waterbed mattresses. The fact that water is a dense material has, however, limited its use as a support medium. A waterbed mattress is supported by a heavy frame and the mattress is not moved after it is inserted in the frame and filled with water. Thus, the weight of water within a waterbed mattress does not detract significantly from the use of water as a support medium since a waterbed mattress remains relatively fixed in position.

Water has not been used, however, as a support medium for objects which are moved from place to place during usage, such as pillows. Pillows, and like objects, must be relatively light in weight in order to be mobile. The use of a relatively dense support liquid, such as water, within a pillow would tend to make the pillow immobile and, therefore, unusable.

In view of the recognized usefullness of a liquid, such as water, in providing uniform support, it would be desirable to provide a construction that was able to use water as a support medium and yet was reasonably light in weight. Such a construction could then be used, for example, to provide pillows or similar objects for supporting the human body which would be relatively light and mobile.

Additionally, it would be disirable if a support construction could be provided which uses water as a support medium, is relatively light in weight, and yet is relatively simple in structure. Such a construction could then be mass-produced and sold at a relatively low price.

Prior art patents which deal generally with support constructions having multiple enclosures are U.S. Pat. Nos. 1,795,304; 2,028,060; 2,099,870; 3,802,004; 3,918,110; 2,938,570; 3,983,587; 4,006,501; 4,065,888, and 4,073,021. While disclosing the use of multiple enclosures within a support construction, these prior art patents do not suggest a support construction with can use water as a support medium, can be relatively light in weight and yet can be simple in structure as provided by the present invention.

SUMMARY OF THE INVENTION

It is an object of the present invention to provide a new and improved support construction, using a liquid as a support medium, and being in the following referred to as a "liquid support construction" for short.

The present invention provides a liquid support construction that is relatively light in weight and yet simple in structure. The support construction includes means which define a closed air compartment having an upper outer surface and a lower outer surface. Sheet means are provided, defining upper and lower liquid compartments that respectively bear against the upper and lower surfaces of the air compartment. Also, means are provided to seal the liquid compartment to the air compartment with a seal extending along a boundary of one of the compartments. The liquid compartment is discontinuous along some of the sealing lines; the air compartment is continuous throughout.

Preferably, the air compartment of the support construction has a generally rectangular configuration and the seal between the liquid compartment and the air compartment forms a seal along three sides of the air compartment. The liquid compartment then extends over the air compartment along a fourth side of the air compartment. Valve means may extend into the air compartment and valve means may also extend into the liquid compartment such that the air compartment and liquid compartment may be separately pressurized.

Additionally, a plurality of flow obstructions may be provided within the liquid compartment. The flow obstructions function to prevent a surge of liquid within the liquid compartment when a force is exerted on the liquid compartment. Desirably, the obstructions may be formed by joining the outer surface of the air compartment to the inner surface of the sheet means defining the liquid compartment at a plurality of locations.

Additionally, the invention provides a method for forming a liquid support construction. In one method embodiment, the peripheral edges of a generally rectangular plastic first sheet are sealed to a second sheet with a marginal area on the second sheet remaining outside the seal. The sealed first and second sheets are then folded in such a manner that the first sheet is on the inside of the fold and the overlying adjacent marginal areas on the second sheet are then sealed together. The region between the sealed first and second sheets forms an enclosed liquid compartment while the region on the inside of the fold between the folded portions of the first sheet forms an enclosed air compartment. Additionally, the method includes forming a valve means which leads to the enclosed liquid compartment and forming a valve means which leads to the enclosed air compartment. The method may also include joining the first sheet to the second sheet in a plurality of locations to form a plurality of flow obstructions within the enclosed liquid compartment.

In a second method embodiment for forming a liquid support construction, a flexible tubular member is sealed along seal lines, which lines are displaced inwardly from open ends of the tubular member with marginal regions between the seal lines and the open ends of the tubular member being unsealed. The tubular member is then folded with the unsealed marginal regions in overlying relation with the adjacent marginal regions of the tubular member then being sealed together. Following this, the overlying adjacent tube sides are sealed together to provide an enclosed air compartment with a liquid compartment enclosing the air compartment except at the regions of the seals.

THE DRAWINGS

To illustrate a preferred embodiment of the invention, reference is made to the accompanying drawings in which:

FIG. 5 is a sectional view, similar to FIG. 4, illustrating the liquid support construction in an expanded state with the liquid compartment filled with liquid and the air compartment filled with air;

FIG. 6 is a sectional view taken along the line 6—6 of FIG. 5 illustrating the liquid support construction in its expanded condition;

FIG. 7 is a detailed sectional view illustrating the attachment of a fabric to the exterior surface of the liquid support construction;

FIG. 8 is a perspective view of a plastic tube used in another method embodiment for forming a liquid support construction, with the tube being sealed along lines which are spaced inwardly from the open ends of the tube;

FIG. 9 is a perspective view of the tube of FIG. 8 after forming a plurality of seals between the walls of the tube preparatory to folding of the tube;

DETAILED DESCRIPTION

Figure 1:
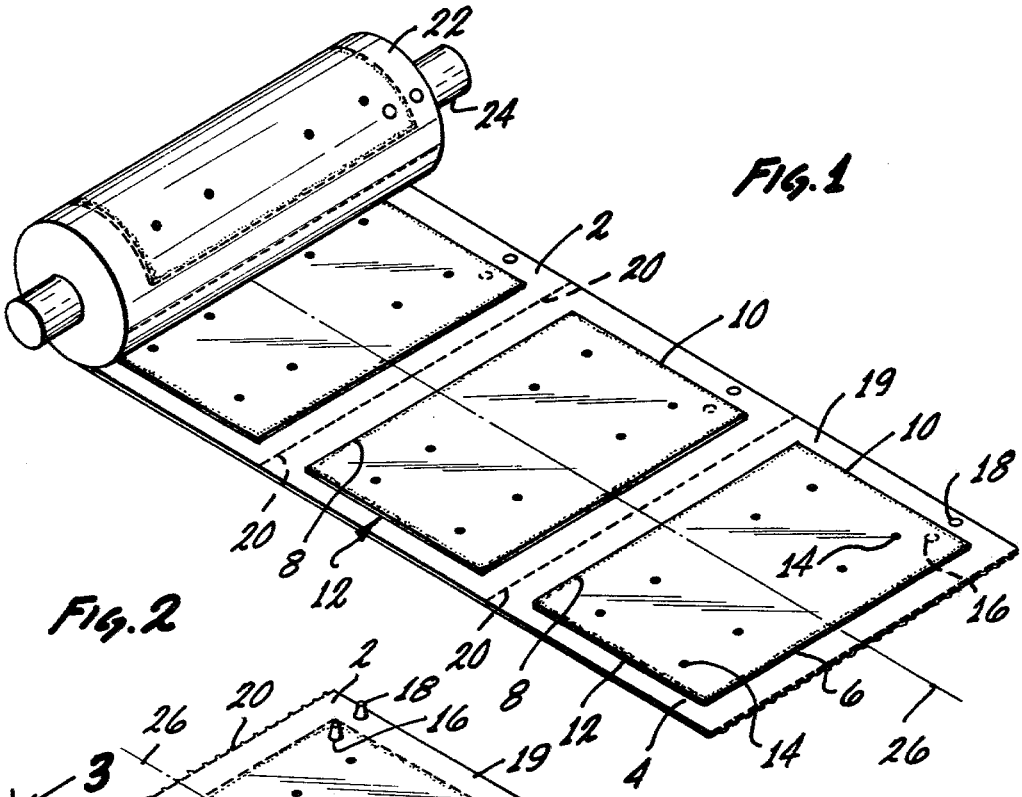
FIG. 1 is a perspective view of the manufacture of a liquid support construction of the invention after sealing of a first sheet to a second sheet with a marginal area on the second sheet remaining outside the seal.

As illustrated in FIG. 1, an outer sheet 2 has an inner sheet 4 sealed thereto by means of transverse seals 6 and 8 and longitudinal seals 10 and 12. Thus, seals 6, 10 and 8, 12 form a continuous margin seal between sheet 4 and sheet 2. Additionally, a plurality of tack seals 14 may join the inner sheet 4 to the outer sheet 2 with the tack seals being uniformly or randomly spaced with respect to the inner and outer sheets. A liquid valve 16 may then extend through the outer sheet 2 into the region between the inner sheet 4 and the outer sheet. Also, an air valve 18 may extend through the outer sheet 2 within the marginal area 19 that surrounds the inner sheet 4.

A plurality of perforation lines 20 may separate a plurality of outer sheets 2 such that a plurality of sealed outer and inner sheets 2 and 4, as described, may be joined together to form a continuous roll 22. The roll 22 may be supported by a roller 24 for convenience in shipping and storage. During the manufacture of a liquid support construction according to the invention, the sealed outer and inner sheets 2 and 4 may be separated along the perforation lines 20.

Figure 2:
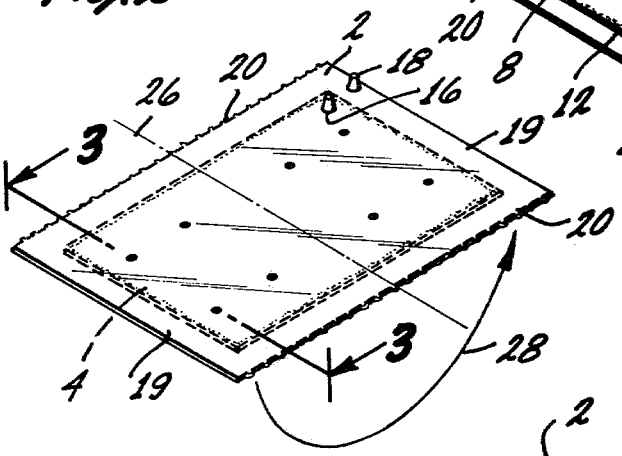
FIG. 2 is a perspective view demonstrating the folding of the sealed first and second sheets as described in FIG. 1, during the manufacture of the liquid support construction.

FIG. 2 illustrates a single outer sheet 2, having a single inner sheet 4 joined thereto after separation from the roll 22 of FIG. 1 along a perforation line 20. After separation along perforation line 20, the outer sheet 2 may be folded along a fold line 26 with the fold occurring in the direction indicated by the arrow 28.

Figure 3:
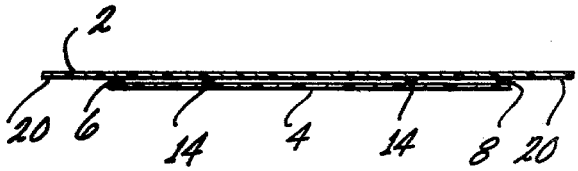
FIG. 3 is an enlarged sectional view taken along the line 3—3 of FIG. 2 to illustrate the sealed first and second sheets prior to folding of the sealed sheets.

The appearance of the outer sheet 2 with the inner sheet 4 sealed thereto prior to folding is illustrated in sectional view in FIG. 3, which is taken along the line 3—3 of FIG. 2. As indicated, the inner sheet 4 is joined to the outer sheet 2 along transverse seals 6 and 8 with the tack seals 14 joining selected portions of the inner sheet 4 and the outer sheet 2.

Figure 4:
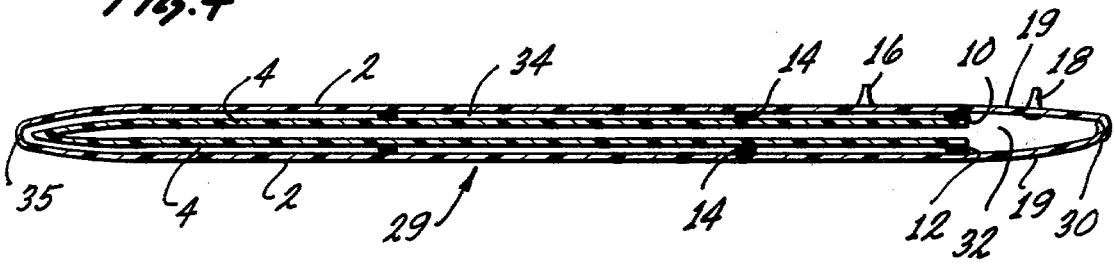
FIG. 4 is a greatly enlarged sectional view of a liquid support construction after folding of the sealed sheets, as illustrated in FIG. 2, followed by sealing together of the overlying adjacent marginal areas of the second sheet.

FIG. 4 is an enlarged sectional view illustrating the structure of a completed liquid support construction 29 after the folding step described in FIG. 2 followed by additional sealing steps. After folding the sealed outer and inner sheets 2 and 4 in the direction indicated by arrow 28 in FIG. 2, the overlying marginal areas 19 on the outer sheet 2 are sealed together. This requires the formation of three seals, one of which is seal 30 along a marginal line, as shown in FIG. 4. After sealing the overlying marginal areas 19 of sheet 2, a compartment is enclosed and sealed. A portion of that compartment is occupied by the liquid compartment 34, the remainder being an air compartment 32, being partially surrounded by the enclosed liquid compartment 34. The enclosed liquid compartment 34 is formed between the inner surface of outer sheet 2 and the outer surface of inner sheet 4; and the seals 6, 8 and 10, 12 seal the margins of sheet 4 against a surface of sheet 2. As indicated, the liquid compartment 34 extends around the air compartment 32 along fold 35 to, thereby, define an upper and a lower compartment.

FIG. 5 is a sectional view, similar to FIG. 4, illustrating the liquid support construction 29 in an expanded condition. As illustrated, the air compartment 32 has been filled with air through the valve 18 while the liquid compartment 34 has been filled with liquid through valve 16. With the liquid compartment 34 in its expanded condition, the exterior of the outer sheet 2 forms a plurality of outwardly curved areas 36 between the tack seals 14 where the outer sheet 2 and the inner sheet 4 are joined. This presents an attractive appearance with the outwardly curved areas 36 resembling tufted regions as provided in overstuffed furniture.

FIG. 6 is a partial sectional view of the liquid support construction 29 taken along line 6—6 of FIG. 5, showing marginal, line-shaped side seals 38 and 40 which, together with marginal end seal 30, form the enclosed air compartment 32. As illustrated, the liquid compartment 34 is discontinuous at the transverse seals 6 and 8 where the inner sheet 4 is sealed to the outer sheet 2. The transverse seals 6 and 8, and also longitudinal, line-shaped seals 10 and 12, shown in FIG. 5, extend along marginal boundaries of the liquid compartment; they are within the outer sheet 2, so that any leakage from the liquid compartment 34 flows into the air compartment 32. This is a desirable feature to insure that leakage from the compartment 34 is confined within the liquid support construction.

The tack seals 14 form a plurality of flow obstructions within the liquid compartment 34. This breaks up the flow of liquid within compartment 34 to prevent a rapid surge of liquid from one portion to another of the liquid compartment when a force is exerted against the exterior of the liquid support construction 29 during usage.

FIG. 7 is an enlarged sectional detail view that illustrates the use of the curved areas 36 on the outer sheet 2 in achieving an attractive tufted appearance. A fabric layer 42 may be positioned in overlying relation to the outer sheet 2 by a button 44 having a shaft 46 which extends through the fabric layer. The shaft 46 may be secured within a backing member 48 positioned on the inner side of the fabric layer 42 with the backing member secured to the outer sheet 2 by means of an adhesive 50.

FIG. 8 illustrates a starting point in an alternative method for forming a liquid support construction according to the invention. As illustrated, the starting material may be a plastic tube 52 which is then sealed along seal lines 54 and 56 that are displaced inwardly from the open ends of the tube.

FIG. 9 illustrates the plastic tube 52 which may extend in a longitudinal direction as indicated by the arrow A in a manner similar to the extension of the outer sheet 2 as illustrated in FIG. 1. A plurality of liquid support constructions may then be formed from a single elongated plastic tube that, for example, be stored in the form of a roll. The plastic tube 52 includes open ends which may be formed by cut lines 58 and 60 with marginal regions 61 between the cut lines 58 and 60 and the seal lines 54 and 56. A liquid valve 62, shown in phantom line drawing, may extend from the undersurface of the tube 52, as shown in FIG. 9, into the interior of the tube while an air valve 64 may extend from the undersurface of the tube completely through the tube. A plurality of tack seals 66 may interconnect the tube walls with the tack seals positioned in a relatively uniform or random manner with respect to the tube 52. The tube 52 may then be folded along fold line 68 to bring the marginal regions 61 into an overlying adjacent relationship.

Figure 10:
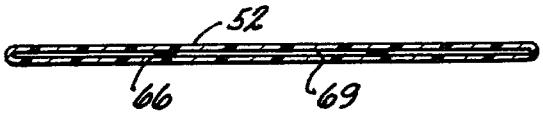
FIG. 10 is a sectional view taken along the line 10—10 of FIG. 9, to illustrate the structure of the tube prior to folding.

FIG. 10 is a sectional view taken along the line 10—10 of FIG. 9 to demonstrate the interior configuration of the tube 52. As indicated, the tube 52 may form an enclosed region 69 with the tack seals 66 interconnecting the walls of the tube.

Figure 11:
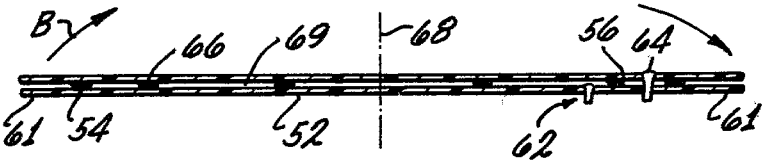
FIG. 11 is a sectional view taken along the line 11—11 of FIG. 9 to illustrate the appearance of the tube prior to being folded and also the manner in which the tube is folded in forming a liquid support construction.

FIG. 11 is a sectional view taken along the line 11—11 of FIG. 9, prior to folding of the tube 25 along the fold line 68. The valve 64 which is in the marginal area 61, passes entirely through the tube 52 and is visible at the upper surface of the tube as shown in FIG. 11. Valve 62, which is positioned between the seal lines 54 and 56, terminates within the enclosed region 69.

Figure 12:
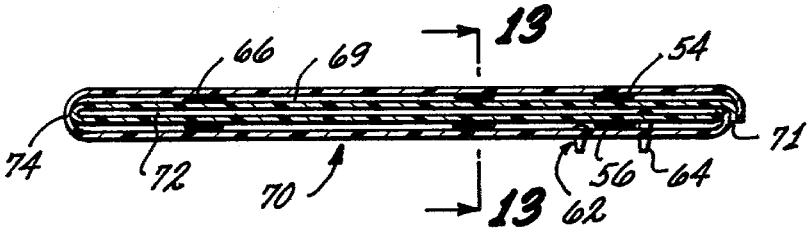
FIG. 12 is a sectional view, similar to FIG. 11, illustrating the appearance of a completed liquid support construction after folding of the tube as illustrated in FIG. 11, followed by sealing together of the overlying adjacent marginal regions of the tube.

FIG. 12 is a sectional view of a completed liquid support construction 70 after folding in the direction of arrow B, as described in FIG. 11, followed by sealing the overlying adjacent marginal regions 61 along an end seal 71. On sealing the overlying edges of the tube 52, as at the end seal 71, an enclosed air compartment 72 is formed with enclosed liquid compartment 69 overlying the air compartment and being sealed by seals 54 and 56. The liquid compartment 69 passes around the air compartment 72 along the fold 74. However, the liquid compartment 69 is discontinuous at the seals 54 and 56 formed between the overlying adjacent edge portions of the tube 52.

Figure 13:
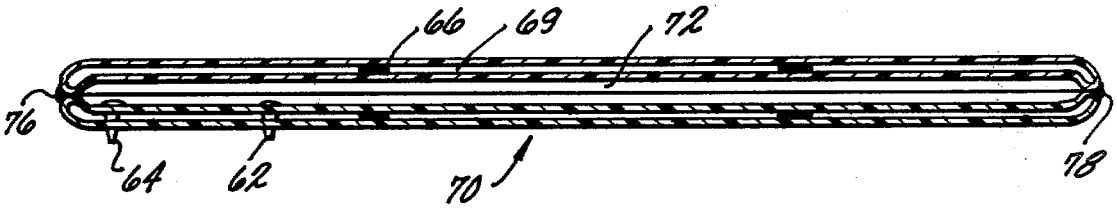
FIG. 13 is a sectional view taken along the line 13—13 of FIG. 12, illustrating the structure of a completed liquid support construction with side seals formed between the overlying adjacent edges of the tube.

FIG. 13 is an enlarged sectional view taken along the line 13—13 of FIG. 12. As viewed in FIG. 13, the valves 62 and 64 are not in alignment. This figure clearly illustrates the valve 62 passing into the liquid compartment 69 while the valve 64 passes into the air compartment 72. Side seals 76 and 78 are formed between the overlying adjacent edges of the folded tube 52, as described in regard to FIG. 11. The side seals 76 and 78, together with the end seal 71 shown in FIG. 12, form the enclosed air compartment 72 and seal that compartment to the liquid compartment 69.

Figure 14:
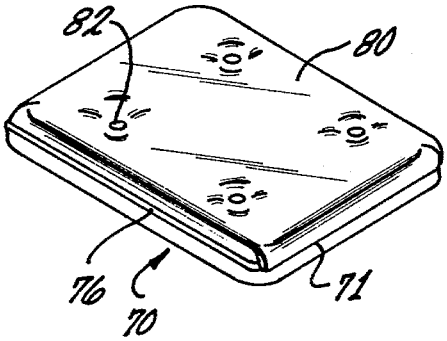
FIG. 14 is a perspective view of the exterior of the liquid support construction of FIG. 13.

FIG. 14 is a perspective view of the liquid support construction 70 of FIG. 13 illustrating the appearance of the exterior surface 80 which includes tufted regions 82. The tufted regions 82 result from the tack seals 66 which may form flow obstructions within the liquid compartment 69. On filling the liquid compartment 69, the exterior surface 80 may be curved at the locations of the tack seals 66 to provide the tufted regions 82.

Figure 15:
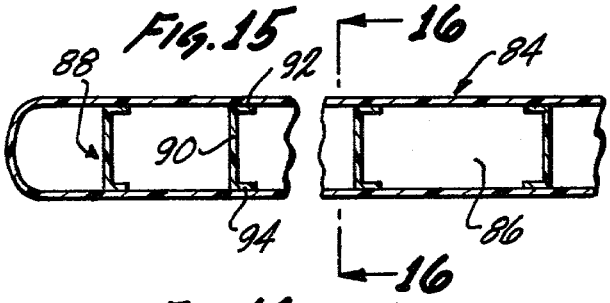
FIG. 15 is a sectional view of an enclosed compartment to illustrate the use of flexible spacer members for maintaining the configuration of the compartment in an expanded condition.

FIG. 15 is a sectional view of an air compartment 84 which, for ease of illustration, does not show an overlying liquid compartment as required in the liquid support construction of the invention. To maintain the configuration of the air compartment 84 when in an expanded condition, the interior 86 may include a plurality of spacer joints generally indicated as 88. The spacer joints 88 may each have a generally U-shaped configuration to include a vertical portion 90 and leg portions 92 and 94. The leg portions 92 and 94 may be sealed to the interior surfaces of the air compartment 84. Accordingly, when the air compartment 84 is in an expanded condition, the upper and lower surfaces of the air compartment may be maintained in a fixed relation by the spacer joints 88.

Figure 16:
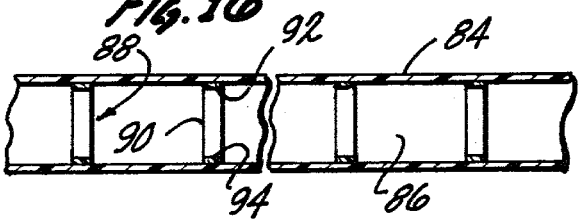
FIG. 16 is a sectional view taken along the line 16—16 of FIG. 15 to further illustrate the configuration of the flexible spacer members within the expanded compartment.

FIG. 16 is a sectional view taken along the lines 16—16 of FIG. 15. As indicated, the vertical portions 90 of the spacer joints 88 may have a generally rectangular configuration with the leg portions 92 and 94 also having a generally rectangular configuration and bearing against the inner surfaces of the air compartment 84.

I claim:

1. A liquid support construction, comprising:

means for defining an enclosed, generally flat, continuous air compartment having an upper outer surface and a lower outer surface;

sheet means for defining an enclosed upper and an enclosed lower liquid compartment which respectively bear against the upper and lower surfaces of the air compartment; and means for sealing the liquid compartment to the air compartment along sealing lines extending along a portion of a boundary of at least one of the compartments, whereby the liquid compartment is discontinuous at the sealing lines adjacent to the air compartment while the air compartment is continuous throughout.

2. The liquid support construction of claim 1, wherein the air compartment has a generally rectangular configuration;

the means to seal the liquid compartment to the air compartment forms a seal between the liquid compartment and the air compartment along three sides of the air compartment, and the liquid compartment extends over the air compartment along a fourth side of the air compartment.

3. The liquid support construction of claim 1 including valve means extending into said air compartment, and valve means extending into said liquid compartment.

4. The liquid support construction of claim 1 including a plurality of flow obstructions within said liquid compartment.

5. The liquid support construction of claim 4, wherein said sheet means as defining the liquid compartment includes an outer surface, having an inner surface means; and said flow obstructions are formed by joining at least one of the outer surfaces of the air compartment to the inner surface means of the sheet means.

6. The liquid support construction of claim 1, wherein the sheet means as defining the liquid compartment having an inner surface, said liquid compartment being defined by said inner surface and by a portion of the outer surfaces of said air compartment.

7. The liquid support of claim 6, including a plurality of flow obstructions within said liquid compartment; and said flow obstructions being formed by joining the outer surfaces of the air compartment to the inner surface of the sheet defining the liquid compartment.

8. The liquid support construction of claim 1, wherein the sheet means for sealing the liquid compartment to the air compartment is enclosed by the air compartment, whereby any leakage of liquid from the liquid compartment flows, due to leaking seal, into the air compartment.

9. A construction as in claim 1, wherein the means for defining an air compartment includes second sheet means being folded and sealed along margins, the sheet means for defining liquid compartments, including at least one sheet sealed to the second sheet means along said sealing lines, said air compartment being a residual space of the second sheet means as folded and sealed, but not occupied by the liquid compartment.

10. A construction as in claim 1, wherein the means and the sheet means are a continuous, flattened tubular sheet, sealed and folded over, said sealing lines extending along overlapping fold margins in order to define the air compartment, and upper and lower liquid compartment, together constituting the liquid compartment.

11. A liquid support construction, comprising:

first sheet means configured and sealed to define a first, flat compartment;

second sheet means, having a margin and being disposed inside the first flat compartment and being further sealed to the first sheet means alongside the entire margin of the second sheet means, in order to define second compartment means together with interior surfaces of the first sheet, the second compartment means being filled with liquid; and an air compartment is defined by a portion of the first compartment, not occupied by the second compartment means, the air compartment being accordingly bounded by surface portions of the second sheet means facing away from the second compartment, and by a portion of the first sheet means.

12. The construction as in claim 11, wherein the margin is a continuous one and the first and second sheet means, as sealed together, are folded over and overlapping portions of the first sheet means being sealed together to, thereby, establish an upper and a lower liquid compartment, the air compartment being disposed in between.

13. A liquid support construction, comprising:

first sheet means provided for establishing a first compartment;

second sheet means disposed inside the first compartment to form upper and lower, liquid-filled compartments, inside the first compartment, a remainder of the first compartment as between the said upper and lower compartments, being an air compartment;

first sealing means effective for sealing the first compartment to, thereby, seal the air compartment;

second sealing means effective for sealing the liquid compartments; and at least one of the first and second sealing means provided for sealing the liquid compartments to the air compartments.

14. A construction as in claim 13, wherein the second sealing means includes sealing lines for sealing margins of the second sheet means to surface portions of the first sheet means, the surface portions facing the first compartment.

15. A construction as in claim 14, wherein the first and second sheet means are separate, folded over sheets, the first sealing means sealing overlapping margins of the first sheet means, the second sealing means sealing margins of the second sheet means to surface portions of the first sheet means to, thereby, seal the liquid compartments to the air compartments.

16. A construction as in claim 13, wherein the first and second sheet means are integral parts of a flattened sleeve having two oppositely located folds, the flattened sleeve being folded over, the first sealing means being effective alongside said folds to, thereby, seal liquid compartments to the air compartments.

* * * * *